United States Patent [19]

Brauch et al.

[11] 4,325,316

[45] Apr. 20, 1982

[54] OMNI-DIRECTIONAL THREAD CUTTER

[75] Inventors: Robert B. Brauch, Wayne; Martin W. Heine, Summit, both of N.J.

[73] Assignee: The Singer Company, Stamford, Conn.

[21] Appl. No.: 205,860

[22] Filed: Nov. 12, 1980

[51] Int. Cl.[3] ..... D05B 65/00

[52] U.S. Cl. ..... 112/292; 112/299

[58] Field of Search ..... 112/292, 291, 295, 298, 112/299; 30/295, 296 R

[56] References Cited

U.S. PATENT DOCUMENTS

| | | | |
|---|---|---|---|
| 207,648 | 9/1878 | Flather | 112/299 X |
| 280,970 | 7/1883 | Staples | 112/299 X |
| 499,352 | 6/1893 | Snapp | 112/299 |
| 2,781,012 | 2/1957 | Kuhar | 112/299 X |
| 3,106,902 | 10/1963 | Foltis et al. | 112/299 |

*Primary Examiner*—H. Hampton Hunter

*Attorney, Agent, or Firm*—James M. Trygg; Robert E. Smith; Edward L. Bell

[57] ABSTRACT

An omni-directional thread cutter in a sewing machine including an annular groove formed in the cylindrical surface of the presser bar. The lower surface of the groove forms an acute angle with the cylindrical surface thereby forming a sharp cutting edge.

9 Claims, 3 Drawing Figures

OMNI-DIRECTIONAL THREAD CUTTER

DESCRIPTION

BACKGROUND OF THE INVENTION

This invention relates to thread cutters for sewing machines of the type manually operated by pulling the thread to be cut against an exposed cutting edge. Various devices have been utilized as thread cutters which attach conveniently to the sewing machine. Such devices usually employ a knife member having either a straight or arcuate cutting edge. The member is attached to the presser bar, or some other part of the sewing machine at a convenient height and position. Examples of such devices are disclosed in U.S. Pat. No. 127,054, May 21, 1872, Harris and U.S. Pat. No. 332,759, Dec. 27, 1885, Spees.

Another line of development has produced cutters which are integral to an existing part of the sewing machine such as the presser foot or presser bar. Examples of these devices are disclosed in U.S. Pat. No. 280,970, July 10, 1883, Staples and U.S. Pat. No. 2,781,012, Feb. 12, 1957, Kuhar. Both of these patents disclose cutters which are formed by a slot machined in the presser foot or bar so that a sharp edge is presented to the operator.

All of the above devices require that the thread to be cut be presented to the cutter from one or two limited directions, thus effecting convenience. Additionally, the cutters of Harris and Spees are arranged so that their cutting edges are relatively unprotected, increasing the risk of injury to the operator.

The present invention overcomes these disadvantages through the use of a novel but simple device.

SUMMARY OF THE INVENTION

It is an object of this invention to provide a thread cutter in a sewing machine whereby the thread to be cut may be presented to the cutter from a variety of directions.

It is another object of this invention to provide a thread cutter which minimizes the potential for operator injury.

It is another object of this invention to provide a thread cutter which is both economical to manufacture and effective in operation.

Other objects and advantages of this invention will become apparent through reference to the accompanying drawings and descriptive matter which describe a preferred embodiment thereof.

According to the present invention there is provided an omni-directional thread cutter in a sewing machine. The cutter comprises an annular cutting edge formed in a substantially cylindrically shaped surface. The cutting edge defines a plane which is approximately coplanar with the work support surface of the sewing machine.

BRIEF DESCRIPTION OF THE DRAWINGS

In order that the invention be more fully understood, it will be described by way of example with reference to the accompanying drawings in which.

DESCRIPTION OF THE PREFERRED EMBODIMENT

Figure 1:
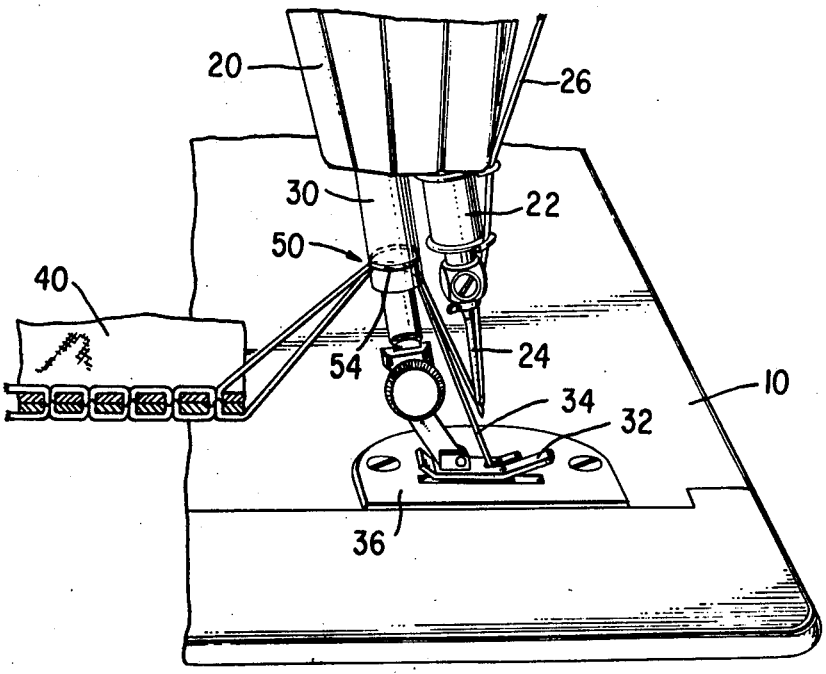
FIG. 1 is a partial perspective view of a sewing machine showing a preferred embodiment of the invention.
Figure 2:
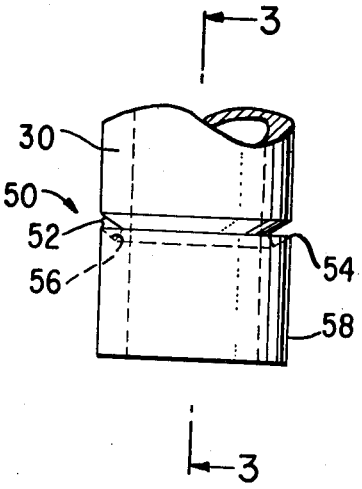
FIG. 2 is a partial side view of the thread cutter.
Figure 3:
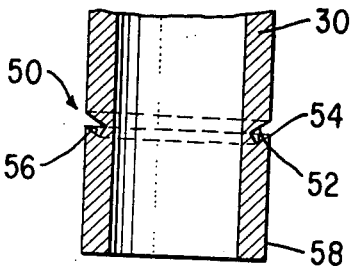
FIG. 3 is a cross section view of the view shown in FIG. 2.

Referring to FIGS. 1, 2 and 3 there is shown a sewing machine having a work support surface 10, a sewing head 20, an endwise reciprocating needle bar 22, and a thread carrying needle 24. A presser bar 30, having a cylindrical surface 58 and a presser foot 32 removably attached thereto is supported in the sewing head 20. A schematic representation of a work piece 40 is illustrated showing a needle thread 26 and a bobbin thread 34 just prior to being severed by a thread cutter 50.

The thread cutter 50, best seen in FIGS. 2 and 3, includes an annular groove 52 which is formed in the cylindrical surface 58 of the presser bar 30. The cylindrical surface may be of circular, hexogonal, rectangular, or triangular cross section, or the like. The groove has a lower surface 56 which, as can be seen in FIG. 3, forms an acute angle with the surface 58 thereby forming a sharp cutting edge 54 at this juncture. The lower surface 56 is of conical shape with its apparent apex pointing downwardly and having an angle of generation of approximately 45°. The apparent apex, therefore, is positioned between the work support surface 10 and the cutting edge 54.

The width of the groove 52 is just sufficient to permit entry of the thread to be cut yet narrow enough to prevent injury should the operator inadvertently come into contact with the cutting edge.

In operation, the threads to be severed are simply held against the presser bar, somewhat above the groove, by the operator, then firmly pulled downwardly so that the threads slide along the cylindrical surface of the presser bar and enter the groove. As the downward motion continues the threads are severed. The groove is positioned on the presser bar at a convenient height so that the severed ends of the threads are sufficiently long to permit resumption of the sewing operation without danger of unthreading the sewing instrumentalities. Importantly, the threads to be severed may be presented to the cutter from a variety of directions. The only requirement being that the threads are brought into pressing contact with the presser bar above the groove and then pulled down into contact with the cutting edge.

Upon reviewing the present disclosure, a number of alternative constructions will occur to one skilled in the art. Such constructions may include a groove of conical shape wherein the apparent apex is pointing upwardly, away from the bed of the sewing machine or simply a groove having nonconical surfaces. Further, the surface within which the groove is formed may be of a cross sectional shape other than circular, such as hexagonal or the like, and may be integral to a member other than the presser bar. Such alternative constructions are considered to be within the spirit and scope of this disclosure.

We claim:

1. An omni-directional thread cutter in a sewing machine including a member having a substantially cylindrical shaped surface and an axis of generation of said cylindrical shaped surface, said surface having an annular cutting edge formed therein generally defining a plane which is substantially perpendicular to said axis of generation.

2. A thread cutter as set forth in claim 1 including a groove having a wall formed in said cylindrical shaped surface wherein said annular cutting edge includes the intersection of said cylindrical shaped surface with said wall of said groove.

3. A thread cutter as set forth in claim 2 wherein said wall is of conical shape.

4. A thread cutter as set forth in claim 3 wherein said conical wall has an apparent apex positioned between said annular cutting edge and said work support surface.

5. A thread cutter as set forth in claims 1, 2, 3 or 4 wherein said annular cutting edge is contained within the boundaries of said cylindrical shaped surface.

6. A thread cutter as set forth in claims 2, 3 or 4 wherein said groove has a width sufficient to permit entry of the thread to be cut yet being sufficiently narrow to prevent inadvertant injury to the operator.

7. An omni-directional thread cutter comprising a member having a substantially cylindrical shaped surface, an axis about which said surface is generated, an annular groove formed in said cylindrical shaped surface, said groove having a wall which intersects said cylindrical shaped surface so that an acute angle is formed at the intersection of said wall and said surface.

8. An omni-directional thread cutter as set forth in claim 7 wherein said member is a presser bar in a sewing machine.

9. An omni-directional thread cutter as set forth in claim 8 wherein said annular shaped cutting edge defines a plane that is substantially perpendicular to said axis.

* * * * *